US011118307B2

(12) United States Patent
Åkerblom

(10) Patent No.: US 11,118,307 B2
(45) Date of Patent: Sep. 14, 2021

(54) REFINER APPARATUS AND A METHOD FOR REFINING CELLULOSIC MATERIAL

(71) Applicant: DAPROX AB, Kungens Kurva (SE)

(72) Inventor: Bengt Åkerblom, Vårby (SE)

(73) Assignee: DAPROX AB, Kungens Kurva (SE)

( * ) Notice: Subject to any disclaimer, the term of this patent is extended or adjusted under 35 U.S.C. 154(b) by 0 days.

(21) Appl. No.: 16/723,674

(22) Filed: Dec. 20, 2019

(65) Prior Publication Data

US 2020/0123705 A1 Apr. 23, 2020

Related U.S. Application Data

(62) Division of application No. 15/115,624, filed as application No. PCT/SE2015/050134 on Feb. 6, 2015, now abandoned.

(30) Foreign Application Priority Data

Feb. 11, 2014 (SE) ..... 1450143-1

(51) Int. Cl.

| | |
|---|---|
| ***D21B 1/36*** | (2006.01) |
| ***D21D 1/30*** | (2006.01) |
| ***D21C 1/02*** | (2006.01) |
| ***B02C 7/12*** | (2006.01) |
| ***B02C 7/14*** | (2006.01) |

(Continued)

(52) U.S. Cl.

CPC ..... *D21B 1/36* (2013.01); *B02C 7/11* (2013.01); *B02C 7/12* (2013.01); *B02C 7/14* (2013.01); *B02C 23/02* (2013.01); *D21C 1/02* (2013.01); *D21D 1/30* (2013.01)

(58) Field of Classification Search

CPC ..... D21B 1/36

See application file for complete search history.

(56) References Cited

U.S. PATENT DOCUMENTS

| | | | |
|---|---|---|---|
| 1,114,339 | A | 10/1914 | Bryant |
| 1,179,429 | A | 4/1916 | Heishman |
| 1,325,413 | A | 12/1919 | Phillips |

(Continued)

FOREIGN PATENT DOCUMENTS

| | | | |
|---|---|---|---|
| WO | WO 2007085703 | A1 | 8/2007 |
| WO | WO 2008098153 | A1 | 8/2008 |

OTHER PUBLICATIONS

International Preliminary Report on Patentability in International Application No. PCT/SE2015/050134, dated Feb. 1, 2016.

*Primary Examiner* — Anthony Calandra

(74) *Attorney, Agent, or Firm* — Knobbe Martens Olson & Bear, LLP

(57) ABSTRACT

The present invention regards a refiner plate segment (1) for a disc-type refiner apparatus (30), adapted to grind a saturated cellulosic material (M) in a refining gap (17) defined by opposed discs (20) during use of the apparatus (30), the material being moved from a refiner inlet opening (21) towards an outer edge (7) of the segment (1). The outer edge (7) of the segment (1) comprises a barrier arrangement (15) to increase the pressure in the refining gap (17) for retaining the liquid phase out to said outer edge (7). The present invention also regards a method of refining a saturated cellulosic material (M) in a refining gap (17) defined by two opposed discs (20) of a disc arrangement.

18 Claims, 4 Drawing Sheets

(51) Int. Cl.
*B02C 7/11* (2006.01)
*B02C 23/02* (2006.01)

(56) References Cited

U.S. PATENT DOCUMENTS

| | | | | |
|---|---|---|---|---|
| 2,035,994 | A | 3/1936 | Sutherland, Jr. | |
| 5,704,559 | A * | 1/1998 | Froberg | D21D 1/008 241/261.3 |
| 5,934,585 | A | 8/1999 | Chaney | |
| 2007/0210197 | A1 | 9/2007 | Carpenter | |
| 2008/0277082 | A1 | 11/2008 | Pschorn | |
| 2009/0221814 | A1* | 9/2009 | Pschorn | D21C 1/02 536/128 |
| 2009/0302140 | A1 | 12/2009 | Johansson | |
| 2014/0217218 | A1* | 8/2014 | Huhtanen | D21D 1/303 241/261.3 |

* cited by examiner

REFINER APPARATUS AND A METHOD FOR REFINING CELLULOSIC MATERIAL

CROSS REFERENCE TO RELATED APPLICATIONS

This application is a divisional of U.S. application Ser. No. 15/115,624, filed Jul. 29, 2016, which is a U.S. National Phase Application of PCT International Application Number PCT/SE2015/050134, filed on Feb. 6, 2015, designating the United States of America and published in the English language, which is an International Application of and claims the benefit of priority to Swedish Patent Application No. 1450143-1, filed on Feb. 11, 2014. The disclosures of the above-referenced applications are hereby expressly incorporated by reference in their entireties.

BACKGROUND

Field

The present invention regards a refiner plate segment as being defined by the preamble of claim 1. The invention also regards a refiner apparatus as defined in claim 5 and a method of refining a saturated cellulosic material according to claim 11. The present invention regards a disc-type refiner apparatus of a refiner plate steam management system.

The present invention is primary related to paper making industry, and refiner producers especially. The invention also regards refiners per se and pulp producing units. It can also be related to making of fiber boards etc. It also relates to Research and Development projects especially having an object to improve energy efficiency in Thermo Mechanical Pulp TMP plants or similar. However, the present invention is not limited to these areas, but also other grinding process management systems as well.

Description of the Related Art

There have been several attempts to improve the efficiency in the grinding of cellulosic fiber material making a high quality pulp for e.g. paper industry. Paper making industry using refiners has interest in saving energy and there is a desire to balance energy consumption and the cellulosic fiber material refining process in an optimal way.

U.S. Pat. No. 6,607,153 discloses a refiner plate steam management system comprising a plurality of bars and grooves for refining a lignocellulosic material. The bars are arranged in a certain pattern for forming a path for receiving and transmitting steam generated during the refining process. Dams are positioned in the grooves at suitable positions for retarding the movement of the lignocellulosic material. The prior art system provides a pressure peak that prevails in the mid section seen in radial direction of the segments, wherein the steam flows radially outward from outer side of pressure peak and radially inward (backward) inside the pressure peak, i.e. against the material feed.

Prior art refining systems have high energy consumption and the flow-through of cellulosic material to be grinded is rather slow and not efficient. The quality of the achieved pulp is often not the same for one production cycle as for another and the refiner plate segments have to be changed quite frequently due to high wear of the grinding bars of the segments.

There is a need to improve current refining systems and refiners. The present invention is provided to save energy for refining procedures and save time in production of e.g. paper. The present invention is also provided to minimize the maintenance and service cost for refiners. The present invention is also provided for improving pulp quality and having an adequate and consistent level of quality in production.

The invention is provided for solving a problem defined by the enclosed independent claims and related to the technical field.

SUMMARY OF THE INVENTION

This has been achieved by a refiner plate segment as defined in the introduction and being characterized by the features of the characterizing part of claim 1.

In such way is achieved a refiner for use in a cost-effective manner by reducing the consumption of energy by means of a steam explosion process and still achieving an improved and uniform quality of biomass pulp for the production of e.g. paper. By means of such "explosion pulping" of the—with liquid, e.g. pure water—saturated cellulosic material (and grinded by the discs), a sudden volatilization of the liquid, entrapped within interstices (pores) of the cellulosic material, is achieved. Thus literally, an "exploding" of the material is noticed when ejected from the refining gap and beyond the outer edge to the outer environment, i.e. from high pressure environment to lower pressure environment. By means of the high pressure environment in the refining gap, which high pressure being increased by means of the barrier arrangement and maintained out to the outer edge of the disc arrangement (comprising at least two grinding discs), the pressure liquid of the saturated cellulosic material can be retained in liquid phase all the way out to the outer edge within the refining gap. Due to the achieved high pressure in the refining gap, the boiling point of the liquid (pure water or mixed water with chemicals or other) of the material can be raised compared with traditional refiners. This implies a boiling point (steam point) at relatively high temperature, thus achieving an extremely cost-effective refining process of the pulp in the refining gap. The refiner plate is combined with other refiner plates and being mounted on the discs to reach optimal grinding. The grinding bars of the respective plate segment are oriented in such way that a pumping of the saturated cellulosic material is achieved propelling the material in radial direction and/or in direction towards the outer edge. At the same time, the centrifugal force, achieved by the rotation of the at least one disc, also forces the hot saturated cellulosic material (the water being in liquid phase) towards the outer edge. By means of the barrier arrangement provided at a limited area of the disc outer edge, and the pump action of the discs, the centrifugal force, and the high boiling point of the liquid of the material due to the created high pressure, the vaporization is controlled to be performed at the outer edge perimeter of the disc arrangement. The vaporization is thus performed in a step of bringing the grinded fiber material from high pressure to low pressure outside the refining gap and barrier arrangement thereby achieving the above-mentioned "explosion pulping". Upon the sudden discharge of the material/water (liquid)/steam mixture from the refining gap, the water (liquid) trapped within the interstices of the cellulosic material will go to steam, thereby providing the necessary energy to produce a high quality "fluffy" pulp mass suitable for e.g. paper making. Vaporization is herein defined as change of a liquid or solid substance to a gas or vapor.

The cellulosic material being fed from centre inlet opening of the refiner disc to the refining gap by means of a pump (e.g. a screw pump with a single screw that rotates in a cylindrical cavity, thereby moving the material along the screw's spindle towards the refining gap) arrangement in communication with the inlet opening. The cellulosic material being fed serves as a "plug" and has a sealing functionality even more providing the pressure in the refining gap to increase.

It is suitably to provide an adjustable gap sensor (AGS) for detecting the width of the refining gap. It can preferably be mounted in the disc segment adjacent the outer edge of the disc, Of course, also other positions are possible for measure the refining gap. It is suitably to use an AGS of the type described in WO 2005/083408.

It is preferably to control that the steam point is near (located before i.e. upstream the barrier arrangement) the outer edge in the refining gap. That is, during use of the refiner it is suitably to control the refiner performance from detected fiber concentration. This can be made by correlating water amount inflow in the refining gap. One way to detect the position of the steam point is to use a system disclosed in the Swedish patent application SE 1351299-1. Such continuous measurement of the steam point will contribute to an improved production using the refiner apparatus disclosed herein.

Suitably, the barrier arrangement comprises a continuous lateral bar member.

In such way is achieved an optimal sealing of the refining gap. As the disc per se carrying the segments is somewhat resilient, in case of overpressure, the disc will release the pressure automatically. Thereby is provided overload security functionality.

Preferably, the height of the barrier arrangement, such as a circular bar provided at the grinding surface of the disc when the segments are provided, is the same as the height of the grinding bars.

Alternatively, the barrier arrangement extends along the outermost edge of the segment and faces the opposite disc.

In such way only one of the discs has to be provided with a barrier arrangement still achieving the higher pressure and a well defined evaporation point at the outer edge of the discs.

Preferably, the barrier arrangement comprises a lateral barrier bar having an inner side facing the inlet opening of the refiner.

Suitably, the barrier bar also comprises an upper side extending at the same plane as the grinding bars upper sides. This will promote cost-effective edging and sharpening of the segment, as an edging apparatus with easy handling can be moved over the grinding bars and barrier bar during sharpening.

Preferably, the barrier arrangement comprises a plurality of barrier bars arranged in the outer edge of the segment.

Suitably, the barrier bar exhibits an outer side opposite the inner side of the barrier bar, which outer side preferably is even with the outer side perimeter of the disc and segment edge sides.

Preferably, the barrier arrangement faces ends of channels formed by grinding bars of the segment.

In such way is the built up pressure achieved by means of the pumping effect by the grind bars and the centrifugal forces and moved out in a well defined position to the outer edge of the disc (i.e. of the segment) and the barrier arrangement. The material is grinded by the opposite grinding bars of respective disc moving in relative motion to each other and the material being grinded are propelled in a direction towards the outer edge of the disc (i.e. of the respective segment) in said channels of the segments.

This has been achieved also by a refiner apparatus characterized by the features of the characterizing part of claim 5.

Thereby the effect of grinding the material can be decreased and energy needed for the process is lower than current refiners, still making a high quality pulp for e.g. paper. This is achieved by the use of the barrier arrangement in the outer edge of the discs and by making use of a so called "masonite effect", i.e. a sudden volatilization of the liquid entrapped within interstices (pores) of the cellulosic material.

In such way is achieved a cost-effective refiner apparatus. By means of the high pressure environment in the refining gap, the boiling point of the water (pure water or mixed water with chemicals or other) of the material can be raised compared with traditional refiners. This implies a boiling point at relatively high temperature, thus achieving an extremely cost-effective refining process of the pulp in the refining gap. The grinding bars of the respective plate segment are oriented in such way that a pumping of the saturated cellulosic material is achieved propelling the material in radial direction and/or in direction towards the outer edge. At the same time, the centrifugal force, achieved by the rotation of the at least one disc, also forces the hot saturated cellulosic material comprising hot water in liquid phase towards the outer edge. By means of the barrier arrangement provided at a limited area of the disc outer edge, and the pump action of the discs, the centrifugal force, and the high boiling point of the liquid of the material at the outer edge, the vaporization is controlled to be performed at a well-defined area of the outer edge of the refiner. Thereby no forces act upon the material backwards in a direction towards the inlet opening. Upon the sudden discharge of the material/water/steam mixture from the refining gap, the water trapped within the interstices of the cellulosic material to steam thereby providing the necessary energy to produce a high quality pulp mass suitable for e.g. paper making. The cellulosic material being fed trough the inlet opening serves as a "plug" and has a sealing functionality even more providing the pressure in the refining gap to increase. The present refiner also propels the material by means of the pump action provided by the grinding bars to an higher rate than current refiners. The pump action of the present discs presents a so called "feeding" of material from the inlet opening towards the outer edge.

In such way is also achieved that all quality parameters of the grinded material is improved. That is, the rate for drying the pulp from water is high, thus further improving the efficiency of the refiner. By moving the steam point of the water to the outer edge of the discs, at which position the pressure falls to lower pressure, there is guaranteed that no unnecessary motion forward and backward (in radial direction) of the steam point is actual in the present refining gap. Such movement otherwise according to prior art must be counter-acted by adding or removing water to the material. For example, if the material has a lack of water, there is needed a very high effect to grind the material. By the present well-defined steam point positioned at the outer edge, a more similar quality and more even production with less fluctuations in production is achieved. As there is no need any longer to taper the discs towards each other, the present disc segments will have longer life as no wear will be present caused by taper adjustments of the discs.

By the present improvements, the energy consumption is extremely reduced compared with current refiners, as paper making of today requires a lot of energy. The present refiner thus promotes for "green technology" applications.

Preferably, the barrier arrangement extends continuously along the outer edge.

In such way is achieved a proper sealing of the refining gap, still the barrier arrangement (bar) forms a narrow aperture (slot) and the opposite positions (with or without any barrier arrangement).

Suitably, the disc arrangement comprises a set of refiner plate segments provided with said barrier arrangement.

In such way a choke of the flow-through of material is provided up to the circumferential edge of the refiner disc arrangement. Such choke means that a high pressure prevails all the way out to the outer edge for keeping the boiling point at said outer edge before the material is "exploded" from the refining gap and outer edge to the outer environment, i.e. from high pressure environment to lower pressure environment. At such sudden volatilization of the liquid entrapped within interstices (pores) of the cellulosic material, the above-mentioned "explosion pulping" is achieved. The discharge of the material/water/steam mixture to the lower pressure involves that the water trapped within the interstices of the cellulosic material will steam, thereby providing the necessary energy to produce a "fluffy" pulp mass suitable for e.g. paper making.

Preferably, the disc arrangement comprises grinding bars being oriented relative each other and relative the refiner inlet opening in such way that an added pump action propels the material towards the outer edge during rotation of at least one disc.

The grinding bars of the respective plate segment are oriented in such way that a pumping of the saturated cellulosic material is achieved propelling the material in radial direction and/or in direction towards the outer edge. The disc arrangement thus may comprise discs, each of which having grinding bars, which discs when rotating relative each other (just one rotating or both) act as a radial-flow pump or centrifugal pump.

Suitably, the barrier arrangement is formed by grinding bar ends ending at the peripheral area of the outer edge.

In such way is achieved that the grinding edges of the grinding bars in an optimal way are used all the "way out".

Preferably, the opposed discs comprise mutual complementary barrier bars to increase said pressure.

By using the same configuration of both discs, the refiner plate segments can be made with identical pattern and barrier arrangements for mounting at both discs. This is cost-effective, both for producing the segments and for maintenance and service at the site as the segments can be the identical for efficient handling.

This has been achieved also by the method characterized by the features of the steps of claim 11.

In such way is achieved high rate (high speed flow-through of material compared with current refiners) for material to pass the refining gap due to the pump action. In such way is achieved a high pumping effect. For saving energy is also the grinding effect less requiring energy as the "masonite" effect will take care of making a high quality pulp. Old current prior art refiners still use the grinding procedure to a greater extent to refine the material, which involves high consumption of energy. In such way is achieved that a high pump effect is provided for reaching the movement of the boiling point of the material out to the outer edge to choke the flow of hot material at a well-defined position of the outer edge for making high pressure and increasing the temperature for vaporisation at the well-defined position.

Preferably, the grinding bars being oriented relative each other and relative the refiner inlet opening in such way that the radial pump action propels the material towards the outer edge.

Suitably, the method is added with the step of adjusting the width of the refining gap on-line by means of a control unit associated with an AGS system, for example of the type disclosed in WO 2005/083408.

Alternatively, the control unit is also associated with a temperature/conductance indicating sensor as e.g. disclosed in SE 1351299-1 for controlling the water supply to the material, wherein the boiling point (steam point) can be controlled to be positioned in the well-defined area achieved by the barrier arrangement.

Preferably, the sealing of the inlet opening is made by the feeding step of moving the material through the inlet opening, wherein the material in the inlet opening also acts as a plug.

In such way the high pressure in the refining gap can be maintained and the motion of the material and liquid is guaranteed towards the outer edge and the pressure peak point is forced out to the outer edge and the barrier arrangement.

Suitably, the step of exposing the material is controlled by a control unit coupled to a gap sensor and/or material mixture detector and/or disc rotation measuring device and/or gap pressure detector means.

Preferably, the outside of the outer edge is performed in a housing encompassing the disc arrangement.

In such way the high quality fine pulp material can be collected outside the disc arrangement and transported to a collecting station for further transportation to e.g. a paper making plant.

BRIEF DESCRIPTION OF THE DRAWINGS

The present invention will now be described by way of examples with references to the accompanying schematic drawings, of which.

DETAILED DESCRIPTION

Hereinafter, embodiments of the present invention will be described in detail with reference to the accompanying drawings, wherein for the sake of clarity and understanding of the invention some details of no importance are deleted from the drawings.

Figure 1:
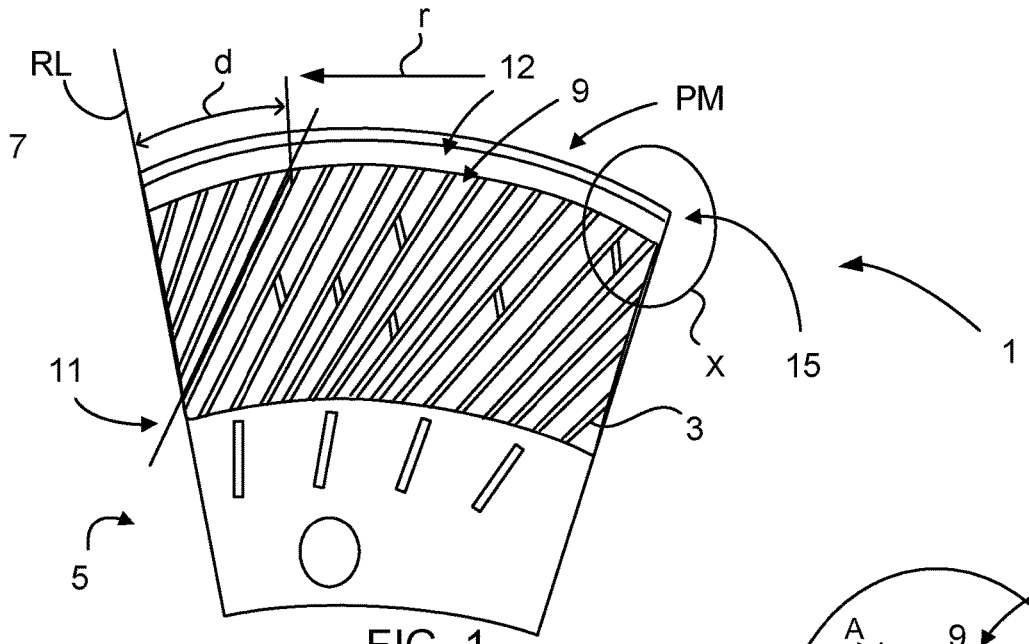
FIG. 1 illustrates a refiner plate segment according to one aspect of the invention.

FIG. 1 illustrates a refiner plate segment 1 showing its interior side comprising a pattern of grinding bars 3. The refiner plate segment 1 together with other refiner plate segments 1 is to be arranged on a first (rotor) and second (stator) refiner discs. The refiner plate segments 1 mounted on the refiner discs constitute an important component of a disc-type refiner apparatus (not shown, see for example FIG. 10), which is adapted to grind a saturated cellulosic material in a refining gap (not shown) defined by the opposed discs during use of the apparatus, the saturated cellulosic material being moved from a refiner inlet opening of e.g. the stator towards an outer edge of the refiner plate segment. The grinding bars 3 are thicker at inner edge 5 compared with outer edge 7 of the refiner plate segment. The grinding bars 3 form channels 9 there between. The grinding bars 3 have sharp edges facing the meeting flow of the cellulosic material for grinding. The relative motion of the discs, in this case only the first is in motion (rotor) and the opposite disc stationary, will cause a pumping force propelling the material from an inlet opening of the second disc towards the outer edge of the disc arrangement. The grinding bars 3 are oriented relative each other and relative the refiner inlet opening in such way that an added pump action propels the material towards the outer edge 7 during rotation of at least one disc. In this embodiment the grinding bars 3 are oblique relative the radial direction (defined as a radial line RL extending the shortest distance from centre to perimeter PM). The majority of the inclined grinding bars 3 extend in such way that their inner ends 11 being closest the disc centre are positioned adjacent the radial line RL and the opposite outer ends 12 of respective grinding bar 3 (i.e. closest the outer edge 7) are facing a barrier bar 15 at a distance d from the radial line RL in a direction opposite the relative rotation P of the discs. The outer edge 7 of the refiner plate segment 1 thus comprises a barrier arrangement 15 (in FIG. 1 formed as a continuous lateral curved bar member) to increase the pressure between the discs 20 (see e.g. FIG. 7*b*) for retaining the liquid phase out to said outer edge 7.

Figure 2A:
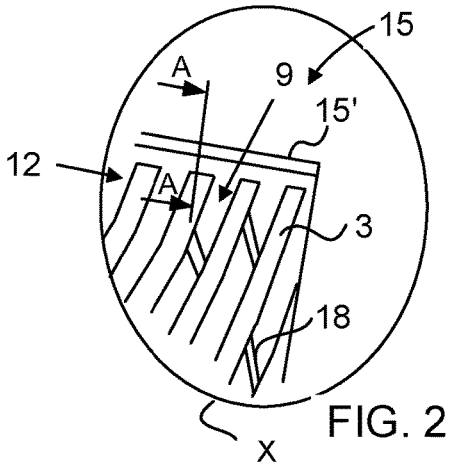
FIGS. 2*a*-2*b* illustrate a section of the plate in FIG. 1.
Figure 2B:
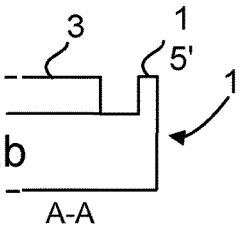

FIGS. 2*a*-2*b* illustrate a section X of the plate in FIG. 1. FIG. 2*a* shows the outer ends 12 of some grinding bars 3. According to this embodiment, the grinding bars 3 end at a distance from the lateral barrier bar 15'. Dams 18 are arranged between the grinding bars 3 for forcing the material under motion to climb over the sharp edges of the grinding bars 3. The dams 18 are positioned in the different channels 9 at irregular places relative each other. FIG. 2*b* illustrates a cross section A-A of the barrier bar 15'.

Figure 3B:
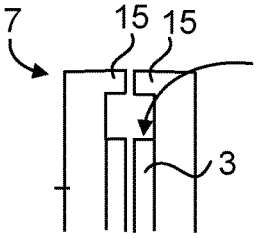
FIGS. 3*a*-3*e* illustrate different aspects of barrier arrangements.
Figure 3A:
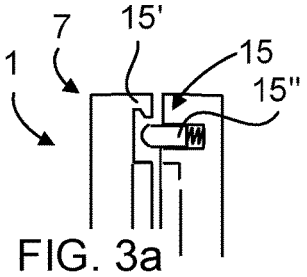
Figure 3E:
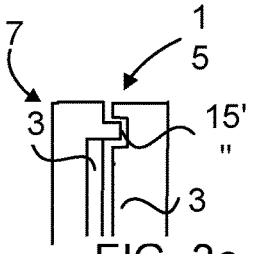
Figure 3C:
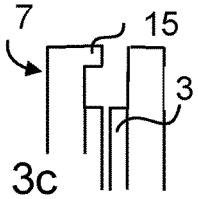
Figure 3D:
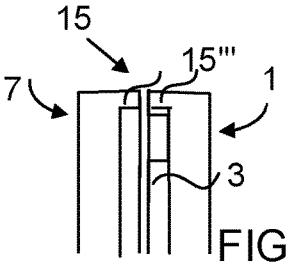

FIGS. 3*a*-3*e* illustrate different aspects of barrier arrangements 15. FIG. 3*a* shows one aspect where a pressure relief valve body arrangement 15" is part of the barrier arrangement 15. The valve body arrangement comprises a plurality of bars, each of which can be depressed into a respective groove of the disc. A spring element presses the respective body in place for choking the flow of hot saturated material out from the refining gap, thus increasing the pressure for achieving a high steam point and locating the steam point to the outer edge before (seen in a direction upstream) the barrier arrangement 15 by means of a pump action, for example of the type described above. FIG. 3*b* illustrates one aspect of a barrier arrangement 15 shown in cross-section. The barrier bar faces ends of channels 9 formed by grinding bars 3 of the segment 1. FIG. 3*c* illustrates one aspect of a barrier arrangement 15 shown in cross-section. Only one of the refiner discs comprises the barrier arrangement 15, still achieving said increased pressure in the refining gap 17. FIG. 3*d* illustrates one aspect of a barrier arrangement 15 shown in cross-section. The barrier bar 15" extends along the outermost edge of the segment 1 and faces the opposite disc and the grinding bars 3 are connected with the barrier bar 15" thus forming a grinding sharp edge all the out to the outer edge 7. FIG. 3*e* illustrates one aspect of a barrier arrangement 15 shown in cross-section, wherein the opposite barrier bars 15''' facing each other form a narrow slot having U-shape in cross section. The opposed discs thus comprise mutual complementary barrier bars 15''' to further increase the pressure.

Figure 4A:
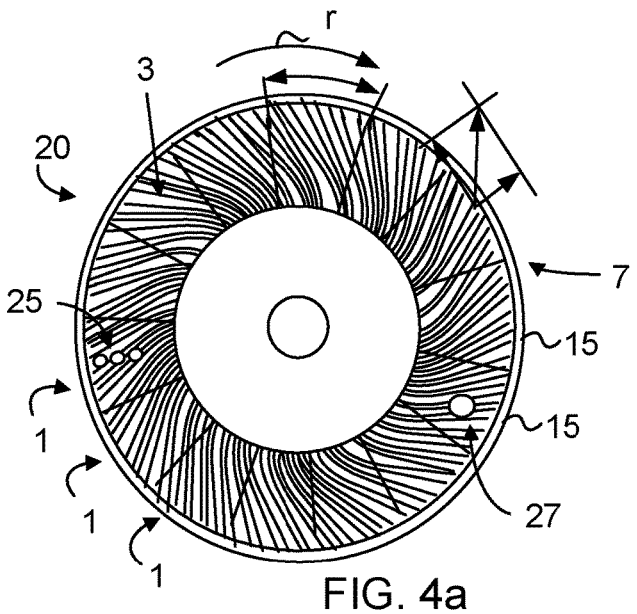
FIGS. 4*a*-4*b* illustrate a refiner disc interior face having grinding bars oriented in a pattern promoting a pump action.
Figure 4B:
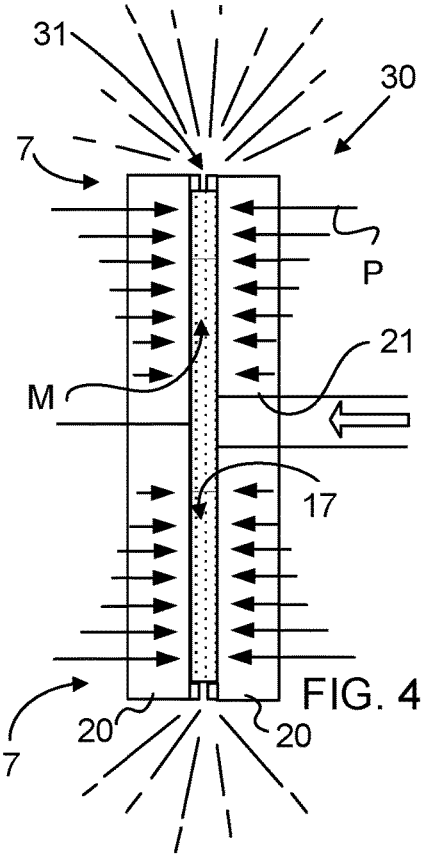

FIG. 4*a* illustrates a refiner disc 20 interior face having grinding bars 3 oriented in a pattern promoting a pump action for propelling the heated saturated cellulosic material in a direction towards the outer edge 7 from the inlet opening 21. The disc 20 arrangement comprises a set of refiner plate segments 1 provided with the barrier bars 15. The added pump action propels the material towards the outer edge 7 during rotation of at least one disc 20. By means of the pump action forcing the material M towards the outer edge 7, and the centrifugal force forcing the material (the water being in liquid phase) in radial direction, heat and pressure have been increased. The material in such way will exhibit all quality parameters. Thus the finest material is near the outer edge 7. According to one aspect of the invention and by means of the i) barrier 15 provided at a peripheral area of the disc outer edge 7 increasing the pressure;

ii) the pump action;

iii) the centrifugal force; and iv) the produced heat;

there will be achieved high pressure that promotes for a high steam point (boiling point) of the liquid embedded in the material M. The steam point is near (located before i.e. upstream the barrier arrangement 15) the outer edge 7 in the refining gap. The refiner performance is managed from detected fiber concentration. This is made by correlating water amount inflow in the refining gap 17. The position of the steam point is detected by a material concentration sensor system which measure the steam point. The position of the concentration sensor 25 is near the outer edge (i.e. where the actual steam point is due). There is also arranged an adjustable gap sensor 27 (AGS) for detecting the width of the refining gap 17, wherein the AGS sensor 27 is mounted in the disc 20. The AGS is mounted near the outer edge 7 of the disc 20. FIG. 4*b* illustrates the both refiner discs 20 of the refiner 30 in a view from side. The saturated cellulosic material (saturated with water and optional also added with suitable chemo-technical compounds) is pressed through the inlet opening 21 into the refining gap. The water filled within the pores of the cellulosic material will be in liquid phase at high temperature due to the high pressure all the way out to the outer edge of the disc arrangement. The step of forcing the grinded cellulosic material from high pressure to low pressure, the material passing through the narrow slot 31 formed by the barrier bar, the low pressure prevailing outside the barrier bar thereby achieving an "explosion pulping". Upon the sudden discharge of the fiber material/water/steam mixture from the refining gap, the water trapped within the interstices of the cellulosic material will go to steam thereby providing the necessary energy to produce a "fluffy" pulp mass. Arrows P indicate the increasing pressure out to the outer edge 7, thus keeping the material and water in liquid phase before "explosion".

Figure 5A:
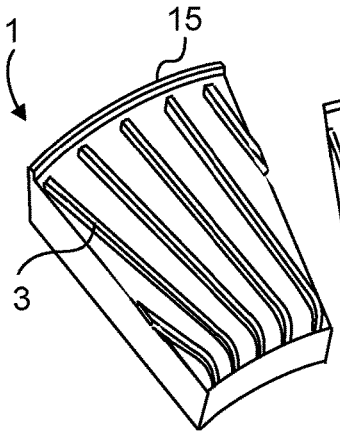
FIGS. 5*a*-5*b* illustrate a refiner plate segment according to one aspect.
Figure 5B:
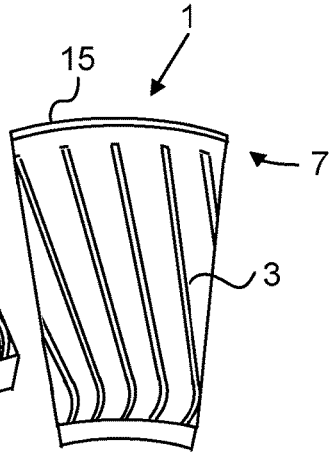

FIGS. 5*a*-5*b* and 6*a*-6*e* illustrate a refiner plate segment 1 according to different aspects. FIG. 5*a* shows in a perspective view the refiner plate segment 1 and FIG. 5*b* the plate face. The number of grinding bars 3 in the FIGs being illustrated schematically fewer than in reality for clarity reasons.

Figure 6A:
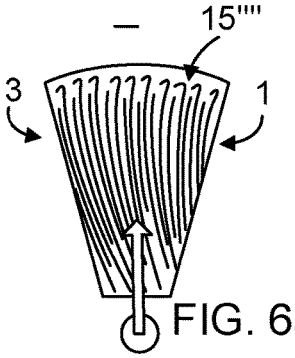
FIGS. 6*a*-6*e* illustrate different aspects of refiner plate segments.
Figure 6B:
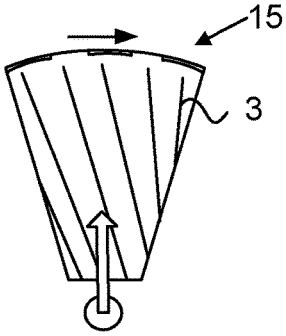
Figure 6C:
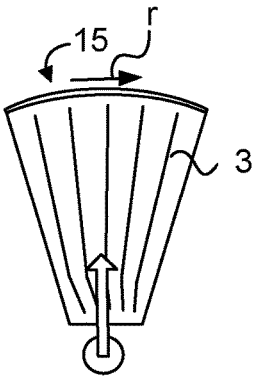
Figure 6D:
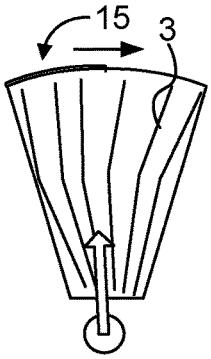
Figure 6E:
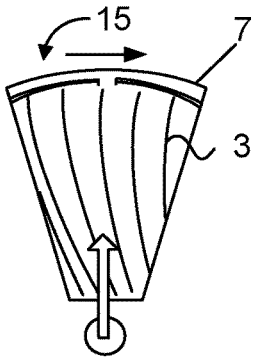

The following FIGS. 6*a*-6*e* also show the rotation direction of the disc and the feeding of material. FIG. 6*a* illustrates a refiner plate segment 1 having grinding bars 3 comprising barrier "sealing hooks" 15"" at the grinding bar 3 ends for increasing the interior pressure in the refining gap. FIG. 6*b* illustrates a refiner plate segment 1 having an intermittent barrier bars arranged along the perimeter of the segment 1. FIG. 6*c* illustrates a refiner plate segment 1 having a continuous barrier 15. FIG. 6*d* illustrates a refiner plate segment 1 having a continuous barrier 15 having half the full length, still generating the high interior pressure. FIG. 6*e* illustrates one aspect of a barrier 15 extending along the outer edge 7 of the segment wherein the grinding bars 3 are joined to the barrier 15.

Figure 7A:
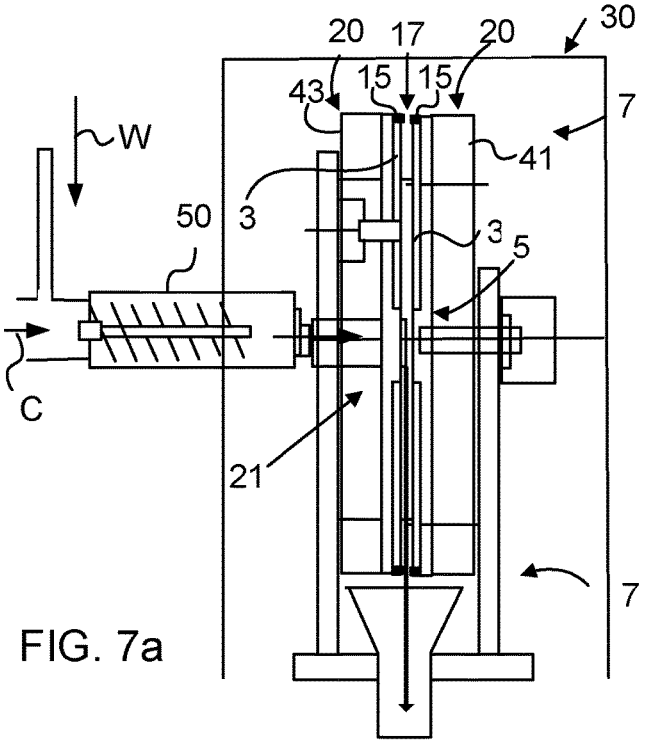
FIGS. 7*a*-7*b* illustrate a refiner according to one aspect of the invention.
Figure 7B:
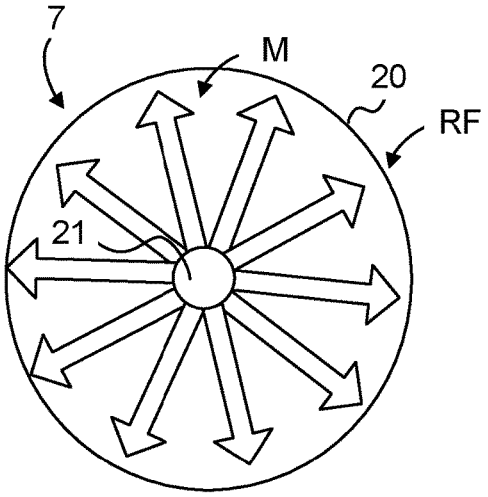

FIGS. 7*a*-7*b* illustrate a refiner apparatus 30 according to one aspect of the invention. The refiner apparatus 30 comprises a rotor 41 and stator 43 disc, each having a plurality of grinding bars 3. A screw pump 50, during use of the apparatus 30, propels the cellulosic material mixed with water W towards the inlet opening 21. The refiner apparatus 30 discs 20 are adapted to grind the saturated ligno-cellulosic material in the refining gap 17, which gap 17 being defined by the opposed discs 20. By means of the screw pump 50, the material M is moved from the inlet opening 21 towards the outer edge 7 of the discs. A sealing of the inlet opening 21 is due by moving the material M through the inlet opening 21, wherein the material M in the inlet opening 21 also acts as a plug by means of the screw pump 50 feeding. In such way, together with the centrifugal force and pump action achieved by grinding bars 3 pattern, the pumping of the screw pump 50 and the plug involves that the refining gap 17 is "sealed" in the direction "down streams". The respective outer edge 7 of the discs 20 comprises a barrier bar 15 to increase the pressure in the refining gap 17 for retaining the liquid phase out to the outer edge 7. The FIG. 7*b* shows the radial forces RF acting upon the material M being grinded.

Figure 8:
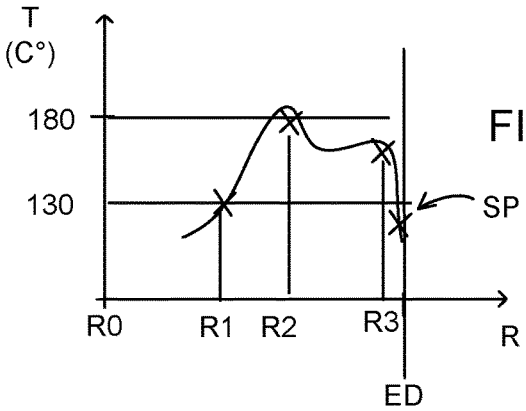
FIG. 8 illustrates a temperature profile seen from the inlet opening to the outer edge according to one aspect.

FIG. 8 illustrates a temperature profile of the material M being grinded in the refining gap 17, shown on a computer screen. The temperature profile is illustrated from the inlet opening R0 to the outer edge ED according to one aspect. The position of R1 is inner edge 5 of the plate segment 1, R3 is the position near the outer edge 7 of the refiner disc 20. The R2 is an intermediate position between R1 and R3. Due to the achieved high pressure, strengthened by means of the barrier arrangement 15 according to one aspect of the invention, the steam point SP can be of high value and maintaining the saturated cellulosic material in liquid state all the way out to the outer edge 7, where pressure goes from high to low. This is shown in FIG. 9*b*. That is, upon the sudden discharge of the material/water/steam mixture from the refining gap 17, the water trapped within the interstices of the cellulosic material will go to steam thereby providing the necessary energy to produce a "fluffy" pulp mass suitable for e.g. paper making. The temperature of the grinded material thus falls to a lower temperature "down streams" (beyond) the barrier arrangement 15. In this example, the temperature is at its highest level at R2.

Figure 9A:
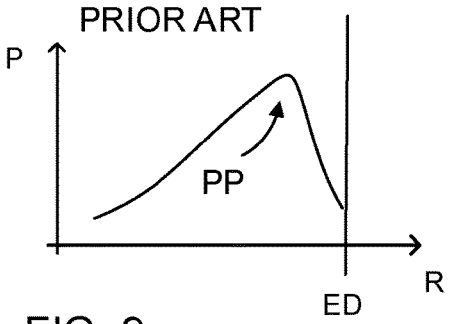
FIGS. 9*a*-9*b* illustrate a prior art pressure profile and a pressure profile that prevails under one aspect of the invention respectively.
Figure 9B:
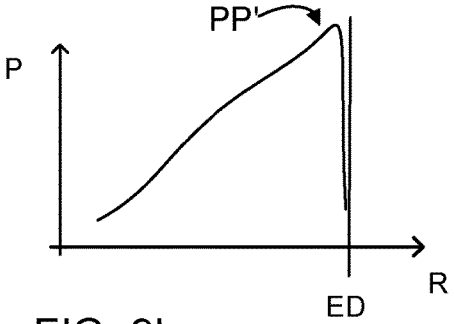

FIG. 9*a* illustrates a prior art pressure profile. The pressure peak PP fluctuates over a rather large distance seen in the radial direction of the refiner disc 20. The pressure peak PP sometimes counteracts the motion of the material and presses it backward. FIG. 9*b* illustrates a pressure profile according to one aspect of the present invention. A pressure peak PP' is held in a well defined position of the refiner disc 20 arrangement, i.e. at a position adjacent the barrier arrangement 15 (on the up-stream side and "before" the barrier), by means of the barrier arrangement 15. The pressure peak PP' is higher than prior art pressure peak PP. The pressure falls at the position of the outer edge ED, or outside it where outside pressure is lower.

Figure 10:
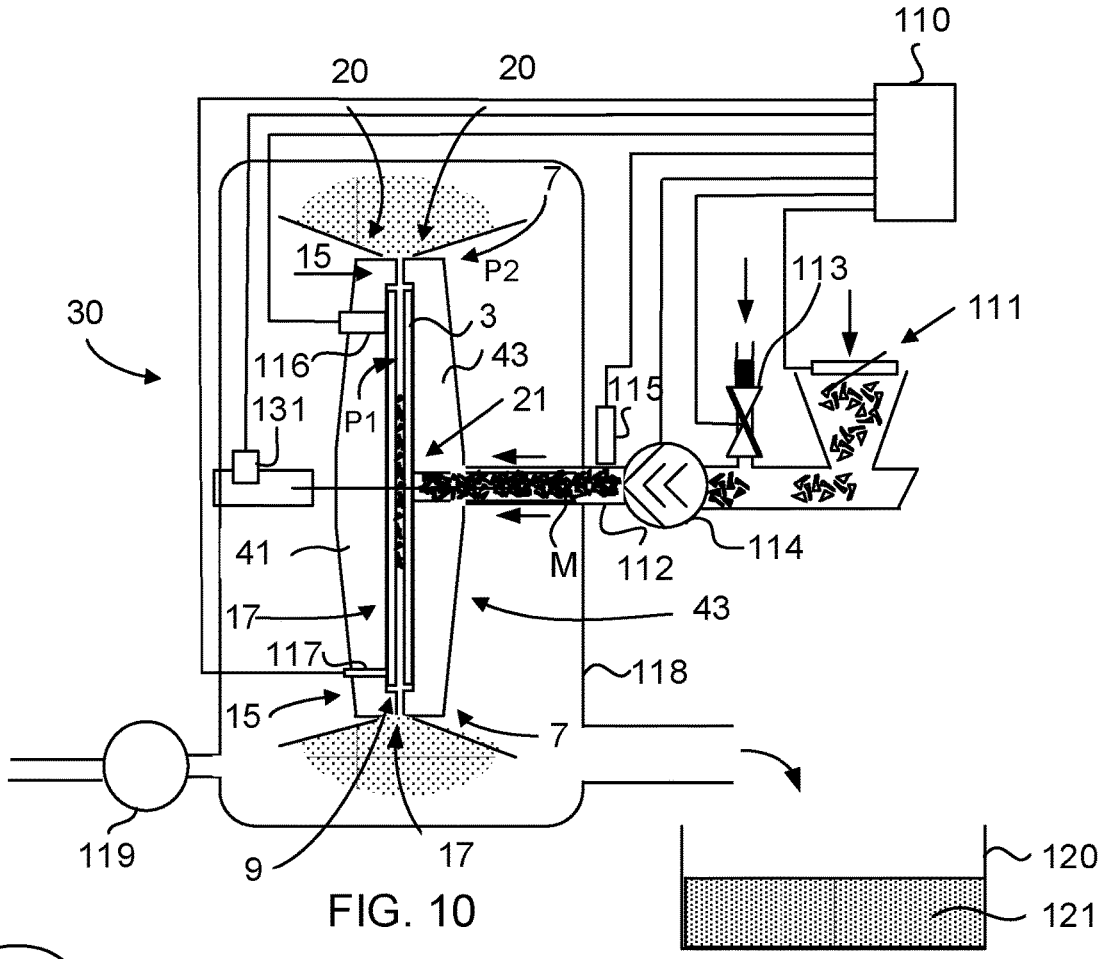
FIG. 10 illustrates a refiner in view of a method to refine a cellulosic material according to one aspect of the present invention.

FIG. 10 illustrates a refiner 30 and a method to refine a cellulosic material (here wood chip material) according to one example of the present invention. The inlet opening 21 is located in the centre of the stator disc 43. The saturated material is pumped through the inlet opening 21 to a refining gap 17. The refining gap 17 is defined by a gap 17 formed by the grinding surfaces ("wet" surfaces of grinding bars 3 and channels 9) of two opposed discs 20 of a disc arrangement. The grinding bars 3 form channels 9 there between. The saturated material being refined is moved from the inlet opening 21 towards an outer edge 7 of the disc arrangement. The outer edge 7 comprises a barrier arrangement 15 in the form of a respective peripheral bar list arranged at the outermost edge of the respective disc 20. A central control unit 100 processor CPU is associated with a wood chip discharger 111 for dispensing proper quantity of cellulosic material to the refining gap 17 via a main pipe 112. A water supply valve 113 is connected to the main pipe for adding proper amount of water (and optionally chemicals) to the wood chip for mixing and saturation of the wood chip. A pump 114 propels the saturated material M to the inlet opening 21 of the stator disc 43. The opposite rotor disc 41 being rotated for grinding the material M. A mixture detector 115 is arranged at the main pipe 112 and being associated with the CPU 110 for detecting proper mixture of the saturized material M. The material M being fed through the inlet opening 21 and into the refining gap 17 by means of the pump 114 located outside the inlet opening 21. The pump 114 is associated with the CPU 110 for controlling the feeding of material M into the refining gap 17 at proper rate. The rotation of the rotor disc 41 is controlled by the CPU 110. The material M is grinded under high pressure and heat. The water of the material M is in liquid state as the steam point is held at a high level by means of the high pressure achieved by the barrier bar 15. The material M is provided under high pressure and temperature by means of the rotating disc 41 acting as a radial pump retaining the material M in the liquid phase out to the outer edge 7. An adjustable gap sensor 116 detects the refining gap 17 width and sends signals to the CPU 110 for adjusting the refining gap 17 to correct measure by means of a linear motor (not shown). A conductive sensor 117 senses the conductivity of the grinded material M including the water being in liquid state for controlling that the water of the grinded material is not in gaseous state. Such control is performed by the CPU 110 controlling that the transition from liquid to gaseous state is performed beyond the barrier bar 15 for achievement of the above-mentioned "explosion pulping". The material M is then exposed outside the outer edge 7, wherein the outside pressure P2 being lower (P2<P1) than the pressure P1 in the refining gap 17 for achieving an explosive decompression of the material M. The rotor disc 41 and stator disc 43 are arranged in a housing 118. The pulp 121 achieved by the "explosion pulping" is forced from the housing 118 due to a slight overpressure in the housing 118 produced by an air pump 119. The pulp is collected in a container 120. A disc rotation measuring device 131 is coupled to the CPU 110 for measuring the rpm of the rotor disc 41.

Figure 11:
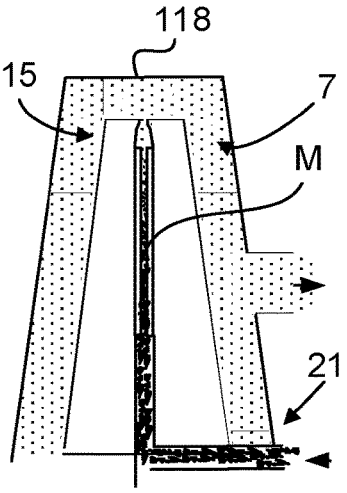
FIG. 11 illustrates a section of the refining gap refining the cellulosic material under high pressure and volatilization of the liquid entrapped within pores of the material "explodes" the material into a high quality pulp for use in cost-effective making of paper.

The grinding bars 3 being oriented relative each other and relative the refiner inlet opening 21 in such way that the radial pump action propels the material M towards the outer edge 7 as shown in FIG. 11. The embodiment shown in FIG. 11 shows barrier bars having sloping inner surfaces.

Figure 12B:
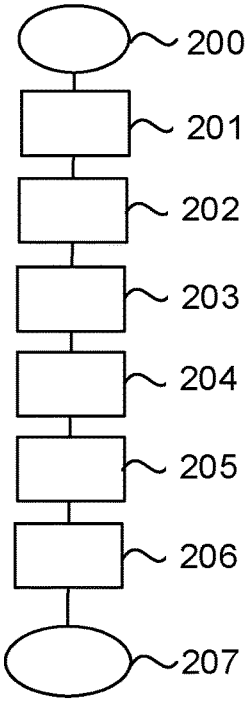
FIGS. 12*a*-12*b* illustrate in flowcharts in different aspects of different methods of refining the cellulosic material.
Figure 12A:
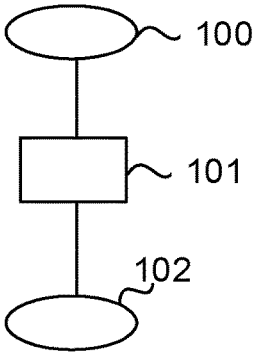

In FIG. 12*a* is shown a flowchart reciting the steps of a method according to one aspect of the invention. In Step 100 the procedure of starting a refining of saturated cellulosic material is achieved. In Step 101 the refining of the material is performed in a refining gap 17, defined by two opposed discs of a disc arrangement comprising grinding bars 3 forming channels 9 there between, wherein the material being moved from a central inlet opening 21 towards an outer edge of the disc arrangement comprising a barrier arrangement 15. Step 101 also comprises the steps of rotating at least one of the disc 20, feeding the material through the inlet opening 21 into the gap 17 by means of a pressure pump located outside the inlet opening, providing the material under high pressure and temperature by means of the rotating disc 20 acting as a radial pump retaining the material in the liquid phase out to the outer edge, and finally exposing the material outside the outer edge, wherein the outside pressure being lower than in the refining gap for achieving an explosive decompression of the material. In Step 102 the procedure is stopped.

In FIG. 12*b* is shown a further aspect of a method for refining a saturated cellulosic material. In Step 200 the procedure starts. In Step 201 the stator disc is rotated by an electric motor. In Step 202 the refining gap is adjusted to a width measure that is selected from empirical values. In Step 203 the material is mixed with a liquid comprising mainly liquid water. In Step 204 the mixture is fed into the refining gap for grinding. In Step 205 the material is subject for feeding towards the outer edge, grinding, generating heat under high pressure maintaining the water of the material in liquid state all the way to the outer edge. In Step 206 the electrical resistivity of the material in the refining gap is measured by means of a sensor device measuring the resistivity of the material adjacent the outer edge. Thereby detection of variations in electrical resistivity is possible. This improves refiner performance. The detection of variations correlates to altered fiber concentration. Adjustment of e.g. the added amount of water to the fiber pad is performed for altering the fiber concentration. In step 207 the procedure is stopped.

In such way is achieved that on-line measurement is achieved within a zone between the refiner discs.

It will thus be possible to control the refiner performance from detected fiber concentration and/or steam point. An user of the refiner can thus cost-effective perform automatic recalibrations during production and continuously correlate water amount inflow in-between the refiner discs, thereby controlling the position of the steam point in radial direction of the refiner discs. Such continuous measurement implied improved production rate as well.

The position of the steam point is important for cost-effective reaching the production of proper pulp quality and at the same time not unnecessary overloading of the refiner, which in turn involves high power consumption.

Step of exposing the material is controlled by a control unit coupled to a gap sensor and/or material mixture detector and/or disc rotation measuring device and/or gap pressure detector means.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims. The fiber pad material preferably comprises cellulose fibers for making paper pulp.

What is claimed is:

1. A method of refining a saturated cellulosic material (M), wherein the saturated cellulosic material (M) is saturated with liquid, in a refining gap defined by two opposed discs of a disc arrangement comprising grinding bars forming channels therebetween, wherein the saturated cellulosic material (M) is configured to move from a central inlet opening towards an outer edge of the disc arrangement, wherein the outer edge comprises a barrier arrangement, wherein the method comprises the steps of:

rotating at least one of the discs;

feeding the saturated cellulosic material (M) through the inlet opening into the gap by means of a pressure pump located outside the inlet opening;

providing the saturated cellulosic material (M) under pressure and a temperature by means of the rotating disc acting as a radial pump retaining the liquid saturated in the saturated cellulosic material (M) in the liquid phase out to the outer edge; and exposing the saturated cellulosic material (M) outside the outer edge, the pressure during exposing being lower than in the refining gap, wherein an explosive decompression of the saturated cellulosic material (M) occurs by a sudden volatilization of the liquid, wherein the liquid is entrapped within pores of the saturated cellulosic material (M), wherein exposing the material (M) outside of the outer edge is performed in a housing encompassing the disc arrangement and the explosive decompression occurs within the housing outside the outer edge.

2. The method according to claim 1, wherein the grinding bars are oriented relative to each other and relative to the refiner inlet opening such that the rotating disc acting as a radial pump propels the saturated cellulosic material (M) towards the outer edge.

3. The method according to claim 1, wherein feeding the saturated cellulosic material (M) through the inlet opening comprises sealing of the inlet opening, wherein the material in the inlet opening also acts as a plug.

4. The method according to claim 1, wherein exposing the saturated cellulosic material (M) outside of the outer edge is controlled by a control unit coupled to a gap sensor and/or material mixture detector and/or disc rotation measuring device and/or gap pressure detector means.

5. A method of refining a saturated cellulosic material, wherein the saturated cellulosic material is saturated with liquid, the method comprising:

feeding the saturated cellulosic material into a refining gap defined by opposed discs of a refiner apparatus, the refiner apparatus comprising a disc arrangement comprising an outer edge, wherein the outer edge of the disc arrangement comprises one or more barrier sections;

retaining the liquid saturated in the saturated cellulosic material in a liquid phase out to the outer edge of the disc arrangement by rotating at least one disc of the opposed discs so as to direct the material to the outer edge of the disc arrangement while the one or more barrier sections are arranged so as to increase the pressure in the refining gap, wherein the one or more barrier sections are arranged such that vaporization of the saturated cellulosic material occurs at an outer perimeter of the outer edge of the disc arrangement such that explosive decompression occurs outside the outer edge and within a housing encompassing the disc arrangement.

6. The method of claim 5, wherein feeding the material into the refining gap comprises feeding the saturated cellulosic material through an inlet opening into the refining gap by means of a pressure pump located outside the inlet opening.

7. The method of claim 6, wherein feeding the saturated cellulosic material through the inlet opening comprises sealing of the inlet opening, wherein the saturated cellulosic material through the inlet opening also acts as a plug.

8. The method of claim 5, further comprising exposing the saturated cellulosic material outside the outer edge, the pressure during exposing being lower than in the refining gap for achieving the explosive decompression of the saturated cellulosic material, wherein the liquid is entrapped within pores of the saturated cellulosic material.

9. The method of claim 8, wherein exposing the saturated cellulosic material outside of the outer edge is controlled by a control unit coupled to a gap sensor and/or saturated cellulosic material mixture detector and/or disc rotation measuring device and/or gap pressure detector means.

10. The method of claim 5, wherein the one or more barrier sections are arranged to form a slot having a width less than a width of the refining gap so as to increase the pressure in the refining gap so as to facilitate retention of the saturated cellulosic material in the liquid phase out to the outer edge.

11. The method of claim 10, wherein the slot is arranged such that the vaporization occurs at the outer perimeter of the outer edge of the disc arrangement such that the explosive decompression occurs outside the outer edge and within the housing.

12. The method of claim 5, wherein the one or more barrier sections extend continuously along the outer edge.

13. The method of claim 5, wherein the disc arrangement comprises a set of refiner plate segments, wherein the refiner plate segments are provided with said one or more barrier sections.

14. The refiner apparatus according to claim 5, wherein the one or more barrier sections are formed by grinding bar ends ending at the peripheral area of the outer edge.

15. The refiner apparatus according to claim 5, wherein the opposed discs comprise mutual complementary barrier bars, wherein the mutual complementary barrier bars are configured to increase said pressure in the refining gap.

16. The refiner apparatus according to claim 5, wherein the one or more barrier sections are arranged to create a discharge from the refining gap, wherein liquid trapped within interstices of the saturated cellulosic material vaporizes to steam.

17. The refiner apparatus according to claim 5, wherein the opposed discs comprise a first disc and a second disc, wherein the one or more barrier sections comprises a first barrier section and a second barrier section, wherein the first barrier section extends from the first disc towards the second disc to a position closer to the second disc than any portion of the first disc defining the refining gap.

18. The refiner apparatus according to claim 17, wherein the second barrier section extends from the second disc towards the first disc to a position closer to the first disc than any portion of the second disc defining the refining gap.

* * * * *